US008186550B2

(12) United States Patent
Sampson

(10) Patent No.: US 8,186,550 B2
(45) Date of Patent: May 29, 2012

(54) BATHING UNIT APPARATUS

(76) Inventor: Alvin H. Sampson, Thomasville, GA (US)

( * ) Notice: Subject to any disclaimer, the term of this patent is extended or adjusted under 35 U.S.C. 154(b) by 490 days.

(21) Appl. No.: 12/289,327

(22) Filed: Oct. 24, 2008

(65) Prior Publication Data

US 2010/0101012 A1 Apr. 29, 2010

(51) Int. Cl.
*A47K 3/022* (2006.01)

(52) U.S. Cl. ..... 224/663; 224/660; 224/662

(58) Field of Classification Search ..... 224/663, 224/662, 660

See application file for complete search history.

(56) References Cited

U.S. PATENT DOCUMENTS

| | | | | | |
|---|---|---|---|---|---|
| 478,662 | A * | 7/1892 | Tuttle | 297/119 |
| 3,227,243 | A * | 1/1966 | Bates et al. | 182/156 |
| 3,826,336 | A * | 7/1974 | Cramer | 182/15 |
| 3,999,629 | A * | 12/1976 | Schaffer et al. | 182/156 |
| 4,130,316 | A * | 12/1978 | Rossi | 297/46 |
| 4,250,977 | A * | 2/1981 | Deli | 182/33.6 |
| 4,485,892 | A * | 12/1984 | Maloney et al. | 182/161 |
| 5,647,071 | A * | 7/1997 | Suzuki et al. | 4/555 |
| 5,937,968 | A * | 8/1999 | Gibson et al. | 182/165 |
| 6,000,497 | A * | 12/1999 | Kain et al. | 182/129 |
| 6,012,548 | A * | 1/2000 | Kim | 182/165 |
| 6,094,756 | A * | 8/2000 | Carter | 4/578.1 |
| 6,212,706 | B1 * | 4/2001 | Rossman et al. | 4/572.1 |
| 6,390,238 | B1 * | 5/2002 | Gibson et al. | 182/161 |
| 6,425,146 | B1 * | 7/2002 | O'Brien et al. | 4/560.1 |
| 6,807,690 | B1 * | 10/2004 | Satterfield | 4/578.1 |
| 6,842,919 | B2 * | 1/2005 | Wilson et al. | 4/578.1 |
| 2004/0129495 | A1 * | 7/2004 | Lamerson et al. | 182/33 |
| 2006/0272085 | A1 * | 12/2006 | Hribsek | 4/579 |
| 2007/0144831 | A1 * | 6/2007 | Cole | 182/33 |
| 2008/0036181 | A1 * | 2/2008 | Goldstein | 280/648 |
| 2008/0092361 | A1 * | 4/2008 | Neidich | 29/428 |

* cited by examiner

*Primary Examiner* — Brian D Nash
(74) *Attorney, Agent, or Firm* — Dickstein Shapiro LLP

(57) ABSTRACT

Embodiments described herein relate to a bathing unit that sits in a bathtub and helps the elderly, handicapped and/or persons with problems that need assistance getting in and out of a bathtub. The bathing unit is a lightweight frame system that comprises four stair-stepped seated levels.

15 Claims, 6 Drawing Sheets

BATHING UNIT APPARATUS

FIELD OF INVENTION

The present invention relates to a bathing unit and in, particular to a bathing unit that allows older and/or disabled persons to more easily enter and exit a bathtub and bathe.

BACKGROUND OF THE INVENTION

Existing conventional bathtubs and showers are designed for an "average" person, but such tubs are difficult to use by persons with disabilities and/or the elderly. The vertical walls of conventional bathtubs must be stepped over to enter and exit the bathtub, which is difficult or impossible for some people. Some devices are available to assist disabled or elderly persons in entering, exiting and using showers, but many such devices do not allow a user to soak in or use a bathtub. The conventional devices cannot be retrofit or temporarily installed into an existing bathtub or shower unit. Accordingly, there is a need and desire for a better device that can assist an elderly or disabled person to enter and exit a bathtub.

DETAILED DESCRIPTION OF THE INVENTION

Embodiments described herein relate to a bathing unit that sits in a bathtub and helps anyone who has a problem getting in and out of the tub when taking a bath without the fear of falling.

Figure 1:
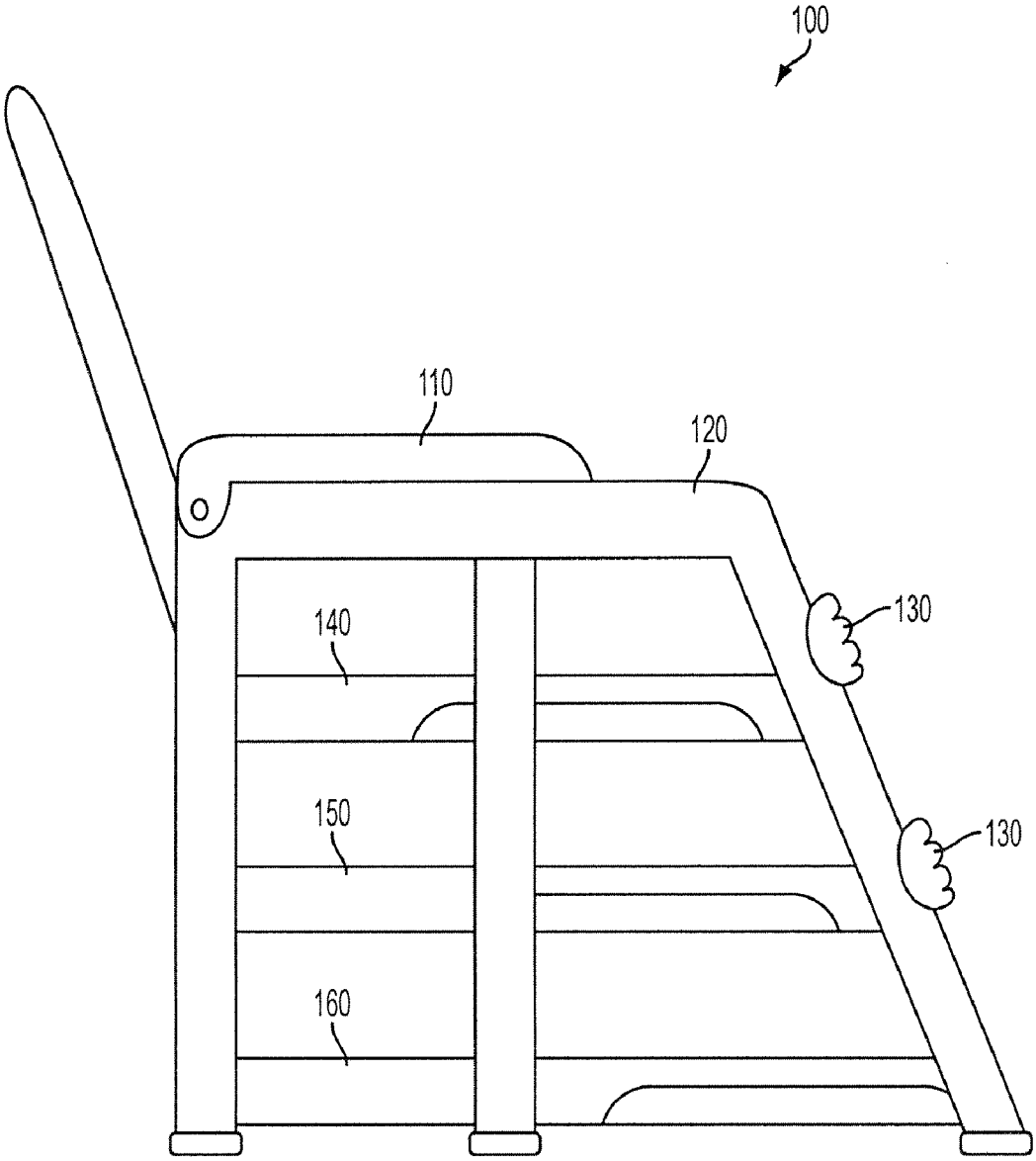
FIG. 1 illustrates a side-view of an embodiment described herein.
Figure 2:
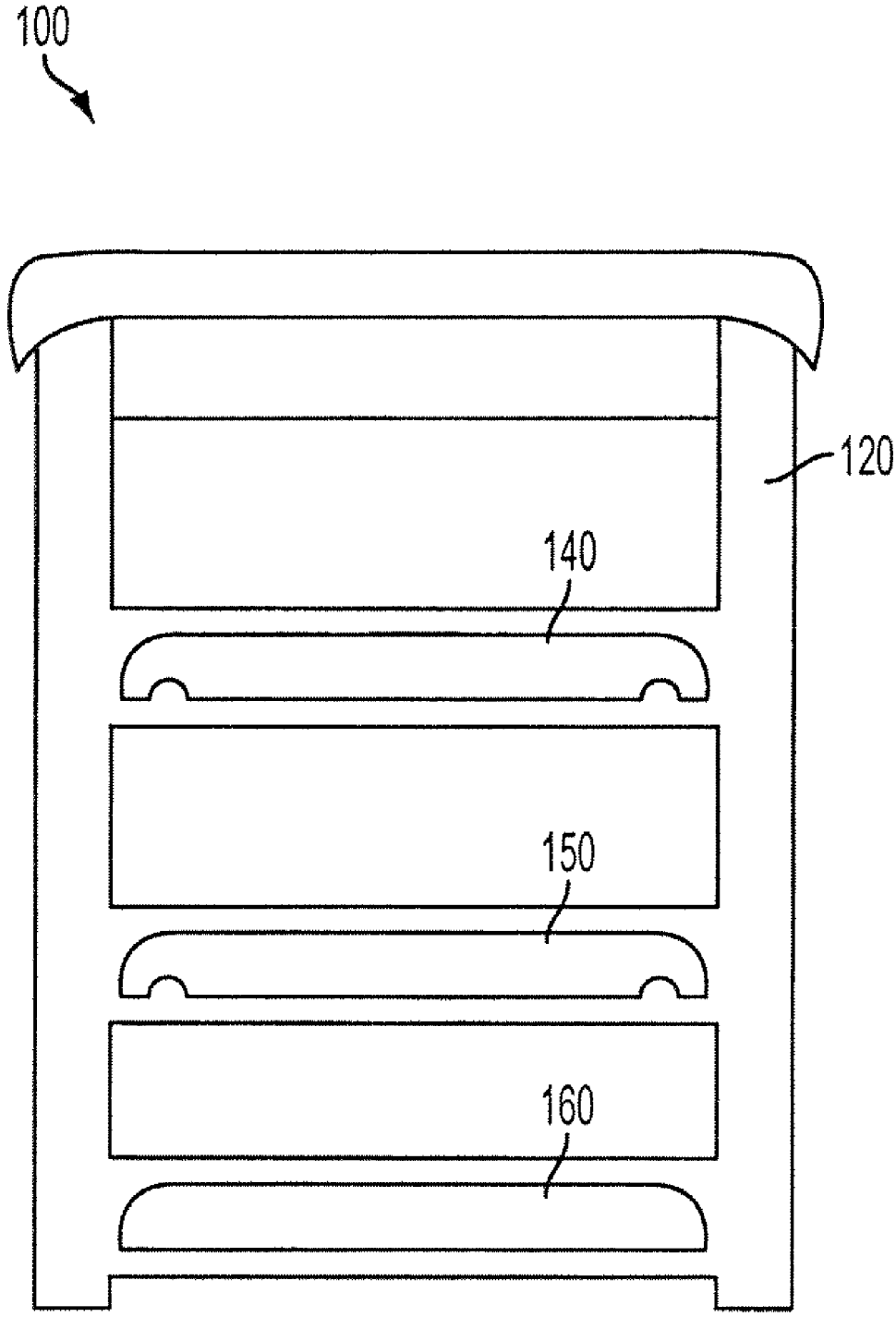
FIG. 2 illustrates a back-view of the embodiment described herein.
Figure 3A:
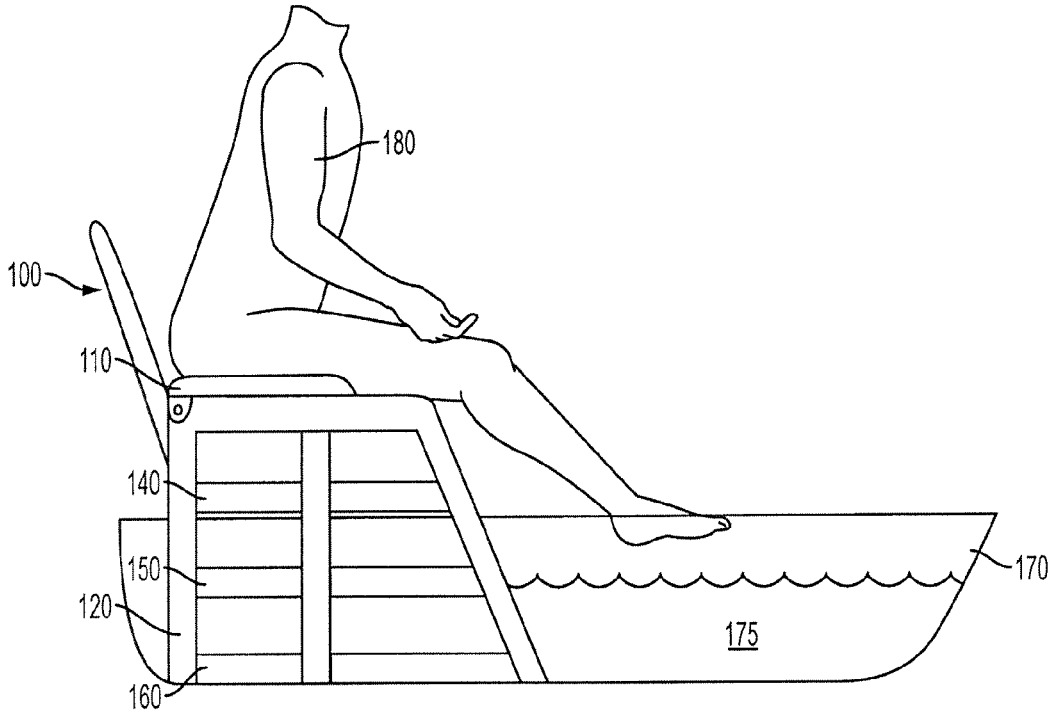
FIG. 3A is a perspective view of a bathing unit according to an embodiment described herein.
Figure 3B:
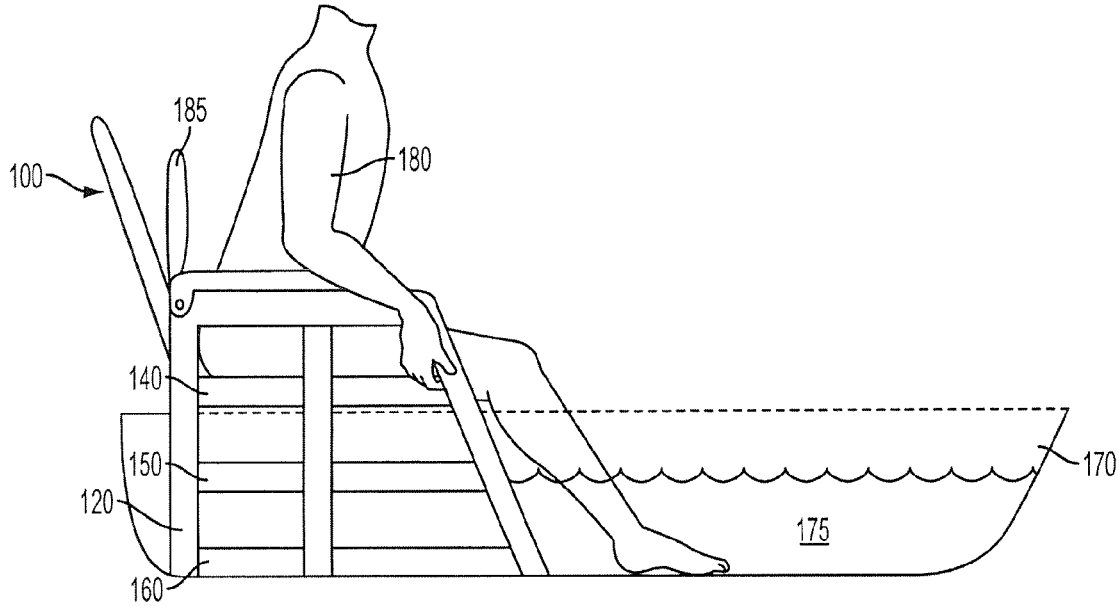
FIG. 3B is another perspective view of the bathing unit according to the embodiment described herein.
Figure 3C:
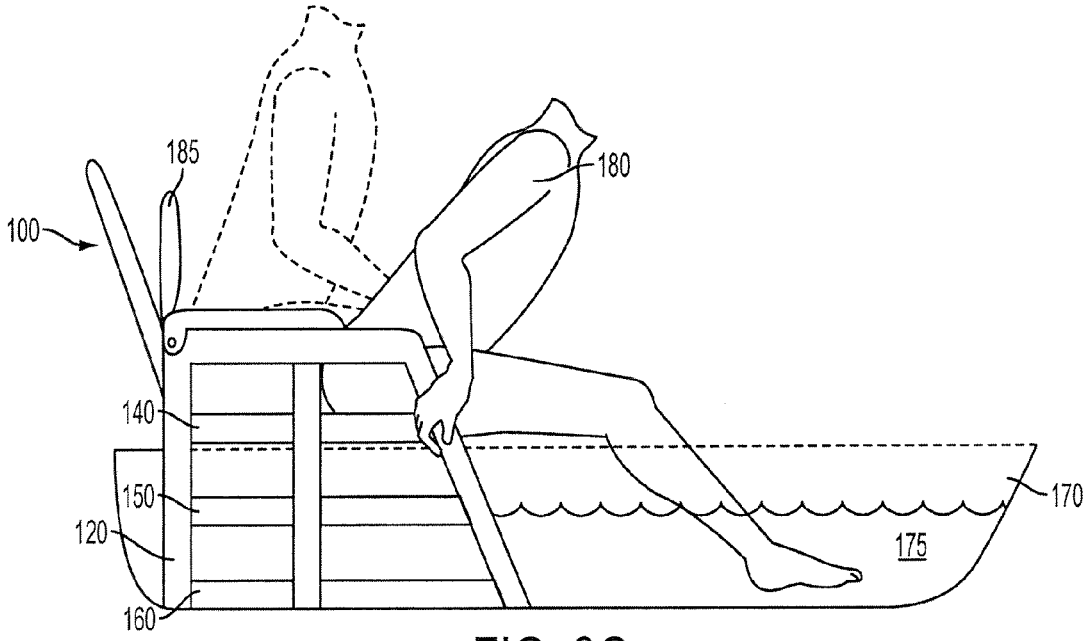
FIG. 3C is another perspective view of the bathing unit according to the embodiment described herein.
Figure 3D:
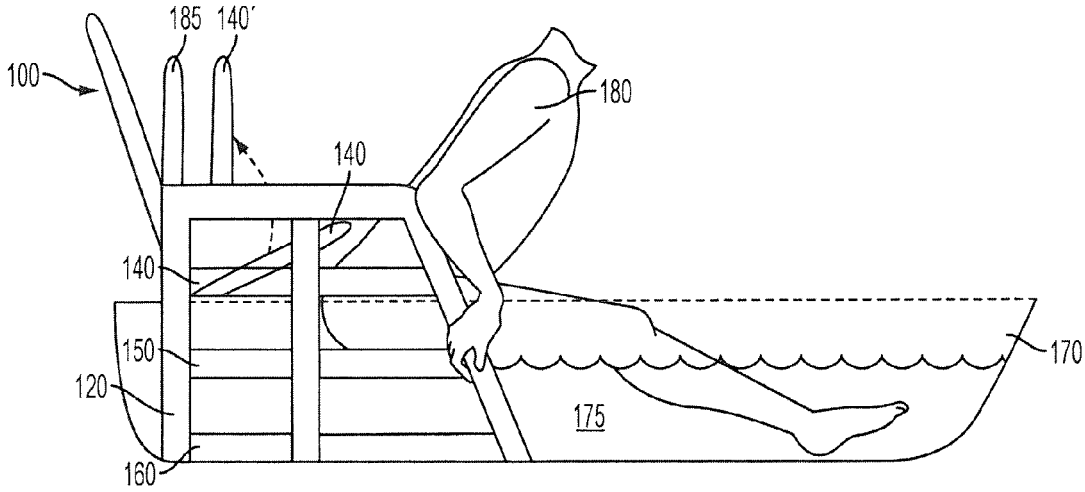
FIG. 3D is another perspective view of the bathing unit according to the embodiment described herein.
Figure 3E:
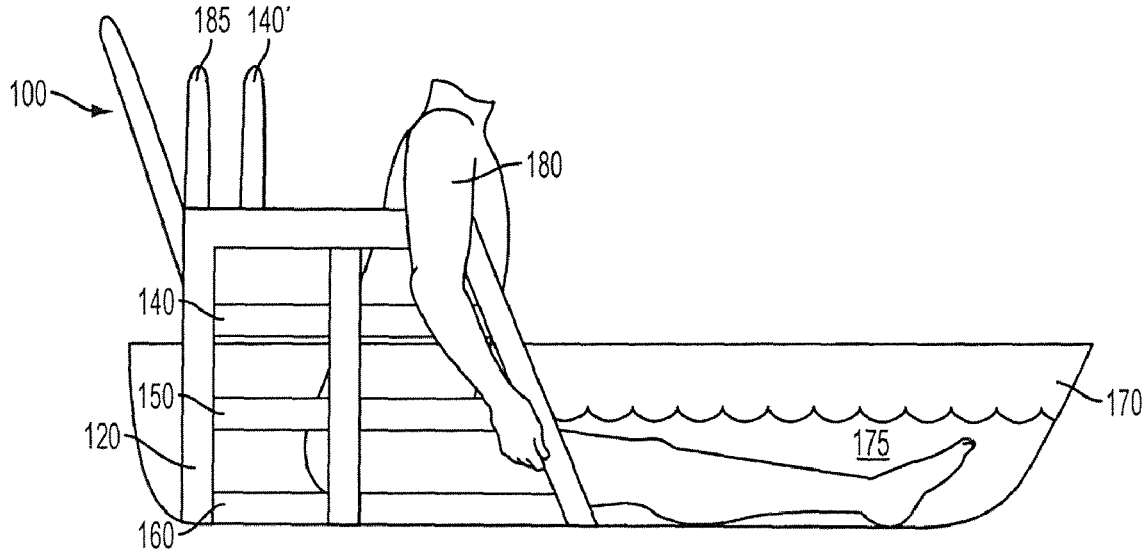
FIG. 3E is another perspective view of the bathing unit according to the embodiment described herein.

In a desired embodiment, the bathing unit is a lightweight frame system that comprises four seats within the frame. Referring to FIGS. 1 and 2, the bathing unit 100 comprises a frame 120, seats 110, 140, 150 and a base 160. Each of the three seated levels 110, 140, 150 above the base 160 are removable and serve as a means for an individual to lower themselves into a bathtub. The first seat 110 and is the highest seat of the bathing unit 100. Below the first seat 110 in a stair step fashion is the second seat 140. Subsequently, below the second seat 140 is a third seat 150. And then again, subsequently below the third seat 150 is a base 160. The stair-step level system formed by seats 110, 140, 150, 160 are supported by the frame 120. The frame 120 is designed to manage the load of the individual while also serving as a hand-rail support system.

The frame 120 can be formed of aluminum, plastic or any other known lightweight, water-resistant and strong material. The seats 110, 140, 150, 160 are preferably made out of plastic material, however, any other known waterproof, lightweight material can be used. It should be appreciated that these lists of materials are intended to be exemplary, and should not be interpreted as exhaustive.

The seated levels 110, 140, 150, 160 can be placed in any known stair-step manner. For example, as illustrated in FIG. 1, consistent with known stair-step systems, the second seat 140 can extend forward (forward being in the direction away from the back portion of the bathing unit) from the first seat 110. Similarly, the third seat 150 can extend forward from the second seat 140, and the base 160 can extend forward from the third seat 150. The front side of the frame 120 includes handgrips 130 for use by the user to enter or exit the bathtub. Although FIG. 1 illustrates two sets of handgrips, the bathing unit 100 can include any number of handgrips. The number of handgrips can be determined based on any particular circumstance and in no way is limited to the illustrations of the present application. It should also be appreciated that the handgrips can be formed in any shape (e.g., round, square, rectangle, contoured to an individual's fingers, etc.), size and/or color. It should also be appreciated that the handgrips can be formed in any known water-resistant material such as plastic, rubber, etc.

In operation, referring to FIGS. 3A-3E for example, a person 180 enters a bathtub by initially sitting down onto the first seat 110. Once seated on the first seat 110, the person 180 moves forward down to the next seat, i.e., second seat 140. Subsequently, once in the second seat 140, the first seat 110 can be lifted up or slid back into a backrest position 185 (as illustrated), or removed from the frame. Then, if not in the water or a desired depth of the water, the person 180 moves forward to the third seat 150, followed by sliding back to form another backrest 140' (as illustrated) or removing the second seat 140. The person 180 moves forward and down to the fourth seat or the base 160. Again, if not in the water or a desired depth of the water, the third seat 150 can be slid back as a backrest or removed. Once seated on the fourth seat (or base) 160, the person is closest to the base of the bathtub 170 and mostly submerged in the water 175.

Figure 4A:
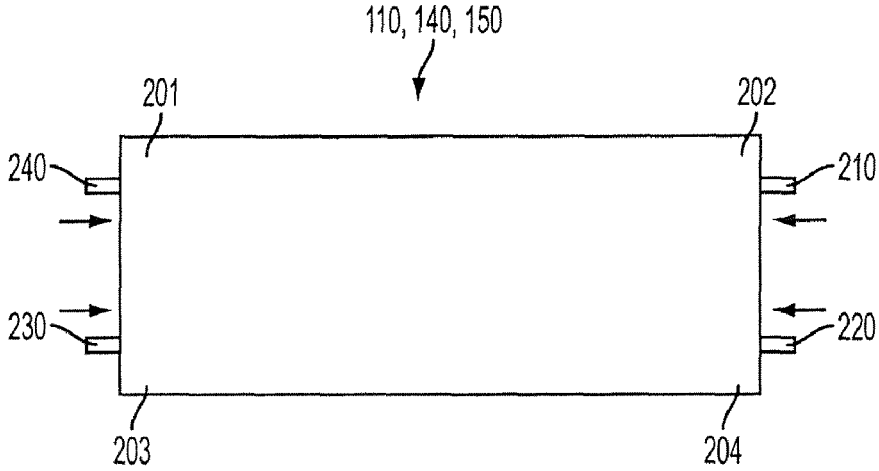
FIG. 4A is a plan view of a component of the bathing unit according to an embodiment described herein.
Figure 4B:
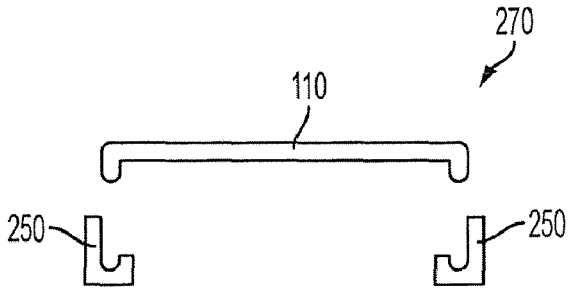
FIG. 4B is a perspective view of a component of the bathing unit according to another embodiment described herein.
Figure 4C:
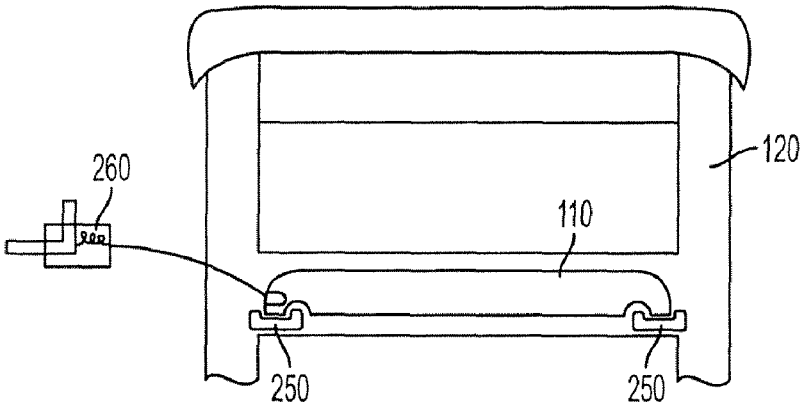
FIG. 4C is another perspective view of a component of the bathing unit according to the embodiment of FIG. 4B described herein.

The first seat 110, the second seat 140, and the third seat 150 are secured to the frame 120 using a four peg locking mechanism, as shown in FIG. 4A. Each seat is secured to the frame 120 at all four corners 201, 202, 203, 204. To remove each seat 110, 140, 150, the peg portion 210, 220, 230, 240 of the seat is pressed inwards and thus released. When both front peg portions 220, 230 and/or back portions 210, 240 are pressed, the seat is unlocked (or released) and can be removed. Alternatively, when both front peg portions 220, 230 are pressed and released, the seat can be rotated upward to the backrest position by rotating the seat around the axis of the back peg portions 210, 240. It should be appreciated, however, that the locking mechanism can comprise a bracket-slide system 270, as illustrated in FIGS. 4B and 4C. The seat (for example seat 110) sits in two brackets 250 along each side which are attached to the frame 120. The bracket-slide system 270 uses a spring lock 260 to secure each seat (for example seat 110) into place. The end of each bracket 250 closes so that the seat does not slide-out of place on its own. In addition, the spring locks 260 can be placed within the brackets on only one side of the seat (as illustrated in FIG. 4C) for securing the seat in position.

The fourth seat 160, on the other hand, is permanently attached to the frame 120 and in the preferred embodiment, is not capable of being removed from the frame 120. It should be appreciated, however, that the fourth seat 160 can be designed to function the same as described above in regards to the first, second and third seats 110, 140, 150.

When a person 180 is ready to get out of the bathtub 170, the person 180 can reverse the procedure described above. For example, the person 180 returns the third seat 150 to its original, locked position and then lifts themselves from the fourth seat 160 to the third seat 150. The second seat 140 is then returned to its original, locked position. The person 180 lifts themselves from the third seat 150 to the second seat 140. The first seat 110 is returned to its original, locked position. The person 180 lifts themselves from the second seat 140 to the first seat 110 and then can exit the bathtub 170.

The bathing unit 100 is designed to be lightweight. The bathing unit 100 can be foldable for storage and/or travel purposes. The seats of the bathing unit can be rotated in an upward fashion (as described above) and the sides of the frame 120 can then be pushed inward to flatten the bathing unit for storage and/or travel purposes.

The bathing unit requires very little work on the part of the individual and requires no help or assistance from additional people other than the person using the bathing unit. The bathing unit 100 is less expensive than existing electronic lifts.

The bathing unit is designed to assist elderly people and/or paraplegics or any other person with back problems that has trouble getting into or taking a bath. It should be appreciated that the bathing unit can be used anywhere a person may bathe such as in a hospital, nursing home, rehabilitation center, hotel, and/or a home.

It should also be appreciated that the bathing unit 100 can be adapted to be a shower chair. For example, if a person 180 sits on the first seat 110 of the bathing unit 100, he/she can then sit in a shower stall and take a shower. It should also be appreciated that the tub described above can also be a shallow pool, hot tub, etc.

The disclosed embodiments can be manufactured in a variety of standard sizes using common components and can be custom fit for a particular individual with special needs. The versatility of the bathing unit 100 allows customization of the bathing unit during the initial manufacturer as well as anytime throughout the life of the device. In this way, the anthropomology (specific anatomical body measurements including but not limited to size, weight, somatype, girth, physical ability and limitation, and range of motion and the like) of an individual with special needs, back problems and/or any other problem can be addressed.

The bathing unit 100 has both prophylactic and therapeutic functions. By allowing a person to bathe, thus facilitating cleansing and removal of waste matter from the skin, the bathing unit 100 prevents infection and inflammation. The bathing unit 100 can be designed to allow a person to partially float thus taking weight off pressure points and enhances circulation in the person. A person with limited control of her body can sit comfortably at rest in the bathing unit in an upright position with their arms resting beside the body with their back bent slightly backward from vertical, and their head resting against the backrest.

The disclosed embodiments of the bathing unit 100 offer the advantage of transferring an individual from a wheeled chair located outside of the bathing area to a base, which is positioned within the bathtub and lowering themselves in an easy and safe manner to submerse the user in water for bathing.

The foregoing description of the claimed invention has been presented for purposes of illustration and description. It is not intended to be exhaustive or to limit the invention to the precise form disclosed, and other modifications and variations may be possible in light of the above teachings. The embodiments were chosen and described in order to best explain the principles of the invention and its practical application to thereby enable others skilled in the art to best utilize the invention in various embodiments and various modifications as are suited to the particular use contemplated.

The invention claimed is:

1. A bathing unit for entering and exiting a bathtub comprising:

a frame system;

a first seat affixed to the frame system on a first axis;

a second seat affixed to the frame system on a second axis below the first seat; and a base seat affixed to the frame system below the second seat, wherein the first seat, the second seat, and the base seat comprise a stair-step system supported by the frame system, wherein the first seat is configured to be movable about the first axis without moving the second seat or the base seat, wherein the second seat is configured to be movable about the second axis without moving the base seat, and wherein the base seat is permanently fixed to the frame system.

2. The bathing unit of claim 1, wherein the first seat and the second seat can be rotated into a backrest position.

3. The bathing unit of claim 1, wherein the frame system comprises an aluminum material.

4. The bathing unit of claim 1, wherein the bathing unit comprises a water-resistant material.

5. The bathing unit of claim 4, wherein the water-resistant material comprises plastic.

6. The bathing unit of claim 1, wherein the bathing unit comprises a waterproof, lightweight material.

7. The bathing unit of claim 1, wherein the first seat and the second seat are each secured to the frame system using a respective peg locking mechanism.

8. The bathing unit of claim 1, wherein the first seat and the second seat are each secured to the frame system using a respective spring lock.

9. The bathing unit of claim 1, wherein the first seat and the second seat are removable.

10. A bathing unit comprising:

a frame system for supporting a first seat, a second seat below the first seat, and a base below the first seat and second seat, the first and second seats each configured to be movable about respective axes by a user, the plurality of removable seats forming a stair-step system for entering and exiting the bathtub and being configured to provide a first use position wherein the first seat, the second seat, and the base are positioned parallel to one another;

a second use position wherein the first seat is positioned substantially perpendicular to the second seat and the base, the first seat providing a backrest for the user;

a third use position wherein both the first seat and the second seat are positioned substantially perpendicular to the base, the second seat configured to provide a backrest for the user; and wherein the base is permanently fixed to the frame system.

11. The bathing unit of claim 10, wherein the first seat, the second seat, and the base each comprise a waterproof, lightweight material.

12. The bathing unit of claim 11, wherein the waterproof, lightweight material comprises a plastic material.

13. The bathing unit of claim 10, wherein the first seat and the second seat are secured to the frame system using a peg locking mechanism.

14. The bathing unit of claim 10, wherein the first seat and the second seat are secured to the frame system using a spring lock.

15. The bathing unit of claim 10, wherein the first seat and the second seat are removable.

* * * * *